US011053092B2

(12) United States Patent
Serra Obiols et al.

(10) Patent No.: US 11,053,092 B2
(45) Date of Patent: Jul. 6, 2021

(54) METHOD FOR FEEDING LAMINAR ELEMENTS INTO AN INSERTION DEVICE AND FEEDING STATION

(71) Applicant: COMERCIAL Industrial Maquinaria Carton Ondulado, S.L., Barcelona (ES)

(72) Inventors: Ramon Serra Obiols, Barcelona (ES); Jordi Puig Vargas, Barcelona (ES)

(73) Assignee: Commercial Industrial Maquinaria Carton Ondulado, S.L.

( * ) Notice: Subject to any disclaimer, the term of this patent is extended or adjusted under 35 U.S.C. 154(b) by 211 days.

(21) Appl. No.: 16/304,210

(22) PCT Filed: May 17, 2017

(86) PCT No.: PCT/ES2017/070324
§ 371 (c)(1),
(2) Date: Nov. 23, 2018

(87) PCT Pub. No.: WO2017/203074
PCT Pub. Date: Nov. 30, 2017

(65) Prior Publication Data

US 2020/0087089 A1 Mar. 19, 2020

(30) Foreign Application Priority Data

May 25, 2016 (ES) ..... ES201630679

(51) Int. Cl.
*B65H 15/02* (2006.01)
*B65H 3/24* (2006.01)
*B65H 5/00* (2006.01)

(52) U.S. Cl.
CPC ..... *B65H 15/02* (2013.01); *B65H 3/242* (2013.01); *B65H 5/006* (2013.01); *B65H 2301/33224* (2013.01)

(58) Field of Classification Search
CPC ..... B65H 15/02; B65H 3/242; B65H 3/322; B65H 5/006; B65H 2301/332;
(Continued)

(56) References Cited

U.S. PATENT DOCUMENTS 2,665,633 A * 1/1954 Schubert ..... B27B 31/00 101/11
2,833,099 A * 5/1958 Rejsa ..... B65B 5/06 53/243
(Continued)

FOREIGN PATENT DOCUMENTS

DE 202004010068 U1 9/2004
EP 1944254 A1 7/2008
FR 2621024 A1 3/1989

OTHER PUBLICATIONS

WIPO, International Search Report, dated Dec. 9, 2017, in International Application No. PCT/ES2017/070324, filed May 17, 2017.
(Continued)

*Primary Examiner* — Gregory W Adams
(74) *Attorney, Agent, or Firm* — Thedford I. Hitaffer; Hitaffer & Hitaffer, PLLC

(57) ABSTRACT

A method for feeding laminar elements into an introducer associated with a graphic printing station provided for printing at least one of the faces of the laminar element, wherein a plurality of laminar elements are grouped in an orderly manner in a stacked group of laminar elements that extends upwards, such that the longitudinal axis of each of the laminar elements is located perpendicular with respect to an advance direction of the group, the advance direction of the group being perpendicular to the advance direction of the introducer. This group of laminar elements is turned 180 degrees with respect to a rotation axis that is parallel to the advance direction of the introducer, such that the upper face of each one of the laminar elements is oriented downwards,
(Continued)

the turned laminar element advancing in a direction perpendicular to the advance direction of the introducer.

9 Claims, 7 Drawing Sheets

(58) Field of Classification Search
CPC .... B65H 2301/333; B65H 2301/33214; B65H 2301/33216; B65H 2301/33314; B65H 2301/34112; B65G 47/252; B65G 47/248; B65G 47/244; B65G 47/54; B42C 19/08
See application file for complete search history.

(56) References Cited

U.S. PATENT DOCUMENTS 3,085,677 A * 4/1963 Magnuson ..... B65H 31/34 198/404
3,503,484 A * 3/1970 Mosetich ..... B65B 35/56 198/374
4,618,341 A 10/1986 Oldham et al.
4,700,941 A * 10/1987 Shill ..... B65H 3/042 271/146
5,039,081 A * 8/1991 Shill ..... B65H 3/242 271/151
5,044,874 A * 9/1991 Shill ..... B65G 59/026 414/796
5,205,704 A 4/1993 Frost et al.
5,354,170 A * 10/1994 Schweingruber ..... B65H 33/16 414/790
5,423,657 A * 6/1995 Frost ..... B65H 3/042 198/861.3
6,230,872 B1 * 5/2001 Huang ..... B07C 3/02 198/368
6,422,375 B1 * 7/2002 Hellman ..... B65G 61/00 198/404
7,631,744 B2 * 12/2009 Brommer ..... B42C 19/08 198/370.09
7,770,718 B2 * 8/2010 Fourney ..... B65G 17/24 198/463.3
8,418,834 B2 * 4/2013 Sardella ..... B65G 47/244 198/415

OTHER PUBLICATIONS

WIPO, Written Opinion, dated Dec. 9, 2017, in International Application No. PCT/ES2017/070324, filed May 17, 2017.

* cited by examiner

METHOD FOR FEEDING LAMINAR ELEMENTS INTO AN INSERTION DEVICE AND FEEDING STATION

CROSS-REFERENCE TO RELATED APPLICATIONS

This application, filed under 35 USC 371, is a United States National Stage Application of International Application No. PCT/ES2017/070324, filed May 17, 2017, which claims priority to ES Application No. P201630679, filed on May 25, 2016, the disclosures of which are incorporated herein by reference.

OBJECT OF THE INVENTION

The object of the present application is to register an introducer assembly for laminar elements, such as cardboard sheets.

More specifically, the invention proposes a feeder station for handling laminar elements, preferably cardboard, and an introducer assembly for laminar elements comprising an introducer that includes the feeder station, wherein turning means are arranged perpendicularly, when seen in plan view, with respect to an introducer.

BACKGROUND OF THE INVENTION

The use of feeder stations (also referred to as "pre-feeder" in the sector) that provide cardboard laminar elements to an introducer that is arranged before a printing station to print at least one of the faces of the laminar elements is known. These feeder stations with respect to the introducer adopt an in-line configuration, i.e. the feeder station and the introducer are axially aligned with each other, wherein the laminar elements move such that the longitudinal element is perpendicular to the advance direction. Although this arrangement is suitable for flexographic printing stations, it is not so suitable in the case of a digital printing station, wherein the longitudinal axis of the laminar elements is parallel to the advance direction.

When a cardboard sheet exits the corrugating machine, the most suitable face thereof to be printed with any printing is oriented downwards. For this reason, when the sheets are to be printed in upper printing stations (i.e. printing is carried out on the upper face of the sheet) they have to be turned beforehand.

In the case of digital printing stations, contrary to those of flexographic printing, the cardboard sheets are inserted such that the longest side thereof is parallel to the advance or insertion direction, this means that in the case of laminar elements with a rectangular contour with a significant longitudinal dimension it is complex to rotate said laminar element such that the upper face is the lower face before entering the digital graphic printing station.

Furthermore, the applicant is not aware of any current invention provided with all the features described in this specification.

DESCRIPTION OF THE INVENTION

The present invention has been developed with the aim of providing a feeder station that has a novel configuration within the field of application and solves the disadvantages mentioned above, while also contributing other additional advantages, which will become evident from the description provided below.

It is therefore an object to provide a method for feeding laminar elements into an introducer, the laminar element having a rectangular contour defined by an upper face and a lower face, in particular for an introducer associated with a graphic printing station provided for printing at least one of the faces of the laminar element, characterised in that it comprises the following stages:

a) extracting a group formed of a plurality of laminar elements of a stack or column of laminar elements grouped in an orderly manner, such that the longitudinal axis of the laminar elements is located perpendicular with respect to an advance direction of the group (the arrangement seen in plan view), the advance direction of the group being perpendicular to the advance direction of the introducer;

b) turning the stacked group of laminar elements 180 degrees with respect to the rotation axis that is parallel to the advance direction of the introducer, such that the upper face of each one of the laminar elements is oriented downwards;

c) advancing the turned group of laminar elements in a direction perpendicular to the advance direction of the introducer through first transport means; and d) moving the group of laminar elements by means of second transport means in the same direction as the advance direction of the introducer, the advance direction being parallel to the longitudinal axis of the laminar elements.

Thanks to these characteristics, the handling time of laminar elements in a work line for printing the same is simplified and reduced.

Advantageously, the first and second transport means are located in a single common area, such that in a first operating condition, the first transport means move the group of laminar elements in an advance direction and in a second operating condition, the group of laminar elements comes into contact with the second transport means that move the group of laminar elements in an advance direction perpendicular to the advance direction of the first transport means.

It is an object of the present invention to provide a feeder station of laminar elements, in particular provided for supplying laminar elements to an introducer, which is characterised by comprising:

- a reception area for laminar elements arranged horizontally;
- turning means for rotating 180° the laminar elements coming from the reception area; and
- a transfer device provided with stop means and movement means for moving in two directions perpendicular to each other, the laminar elements coming from the turning means towards an outlet area oriented in the advance direction of the introducer.

Preferably, the reception area of the feeder station includes lifting means provided for handling a group of laminar elements coming from the stack of laminar elements that is received on a horizontal support platform arranged before the turning means.

Additionally, the horizontal platform may include movement means on which the plurality of laminar elements moves.

In one embodiment, the movement means comprise at least one transport belt movable by means of rotating pulleys that ends in the area where the turning means are arranged.

According to another aspect of the invention, the turning means comprise a structure provided with at least one fork-shaped section provided with a plurality of spikes that define a housing to arrange the group of laminar elements and rotation means coupled to the structure, said rotation means being associated to motor means linked to a control unit.

In accordance with one embodiment of the invention, the transfer device comprises first transport means based on rotating rollers and second transport means based on a conveyor belt linked to rotating pulleys, the rotation axis of the rotating rollers being perpendicular to the rotation axis of the pulleys.

Preferably, the rotating rollers are joined to a vertically movable structure, such that in a first operating position, the contact surface of the rotating rollers with a laminar element is located on a plane above the contact surface of a laminar element with the conveyor belt and in a second operating position, the contact surface of the rollers is located below the contact surface of the conveyor belt.

Preferably, the stop means comprise a plate that is located in a support structure that may move axially arranged in the transfer device. In this way, two supply lines of laminar elements that are parallel with each other may be formed, such that it is possible to increase the operational efficiency for carrying out printing tasks on cardboard sheets or laminates.

Additionally, the stop means may also include guide means to raise and lower the plate.

Lastly, another object of the present invention is to provide an introducer assembly of laminar elements comprising an introducer linked to a feeder station as described above, wherein the advance direction of the introducer is perpendicular to the advance direction of the reception area of the feeder station.

Other characteristics and advantages of the object of the present invention will become clear in light of the description of a preferred, though non-exclusive, embodiment, which, by way of a non-limiting example, is illustrated in the accompanying drawings, wherein:

DESCRIPTION OF A PREFERRED EMBODIMENT

In view of the aforementioned figures and, in accordance with the numbering adopted, an example of a preferred embodiment of the invention can be observed therein, which comprises the parts and elements indicated and described in detail below.

Figure 1:
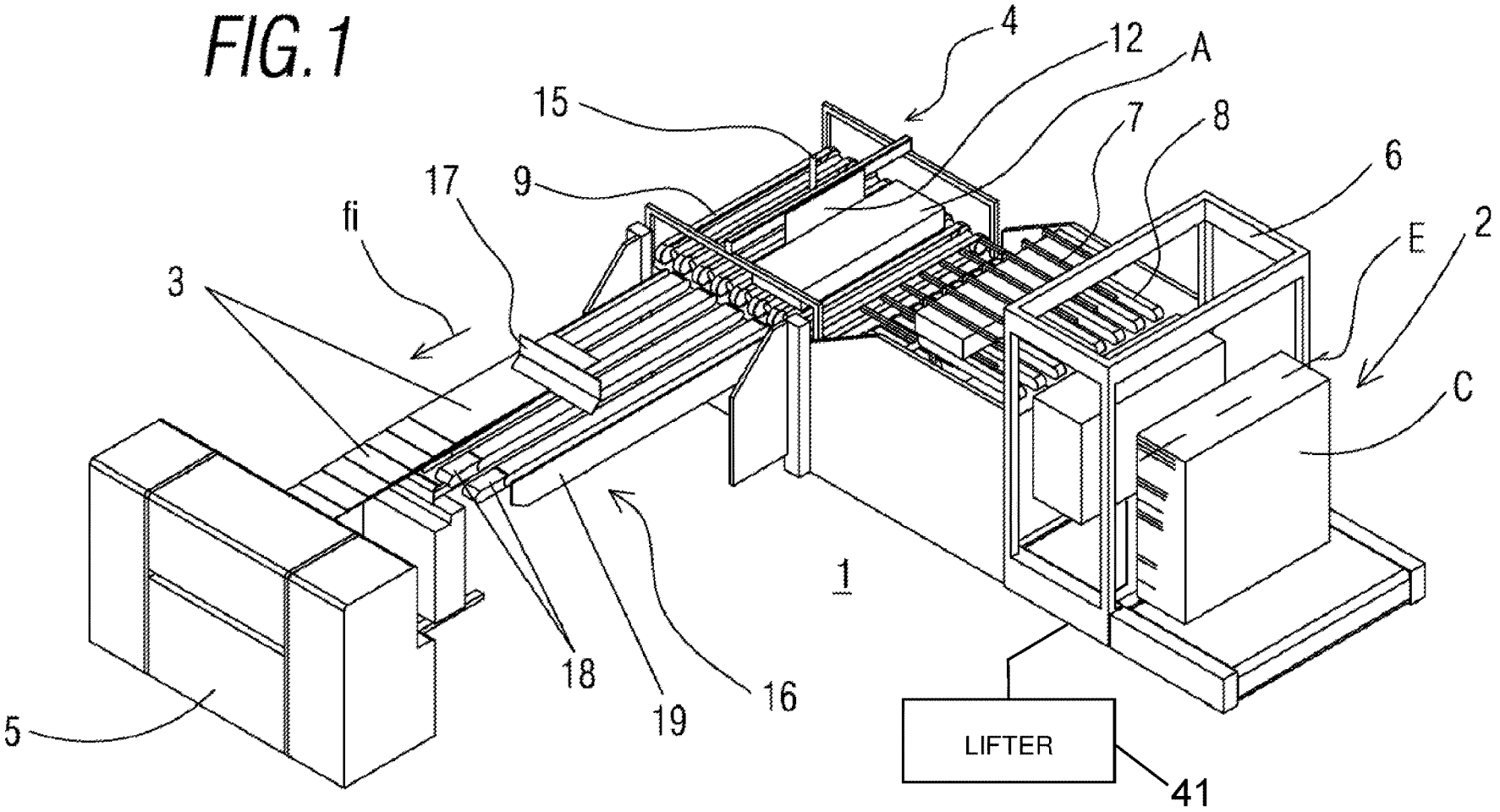
FIG. 1 is a perspective view of a feeder station for handling laminar elements according to the present invention.

As may be seen in FIG. 1, an embodiment by way of example is shown and described of the feeder station of laminar elements, generally indicated with reference (1), which is provided for supplying cardboard laminar elements that, for example, are used to make up cardboard boxes. This feeder station is linked to an introducer, of a known type, for which reason it shall not be described in greater detail. An example of an introducer may be that which is described in Spanish patent No. ES 2547473 by the same applicant.

The feeder station (1) comprises the following main parts:

- a reception area (2) where a stack of the laminar elements (3), each one of them arranged horizontally or parallel to the floor plane, arrives by means of conveyor belts in order to be subsequently divided into groups that are smaller in height in order to be subsequently turned;
- turning means that enable a rotation action of 180° of the laminar elements (3) coming from the reception area (2) that are described below; and
- a transfer device, generally indicated with reference (4), provided with stop means (which shall be explained in detail below) and movement means for moving in two directions perpendicular to each other, the group formed by a plurality of laminar sheets coming from the turning means towards an outlet area oriented in the advance direction of the introducer (5) (represented schematically in the figures), indicated with the arrow (fi).

Returning again to the reception area (2), it also includes lifting means, i.e., lifter (41) (shown in FIG. 1), located in a structure (6) provided for handling and holding a group of laminar elements (3) coming from the stack of laminar elements, towards a horizontal support platform arranged before the turning means.

Furthermore, the horizontal support platform includes movement means on which the group of laminar elements (3) move, comprising a plurality of transport belts (8) arranged parallel to each other, each moving by means of rotating pulleys (not shown) ending in the area where the turning means are arranged.

Figure 4:
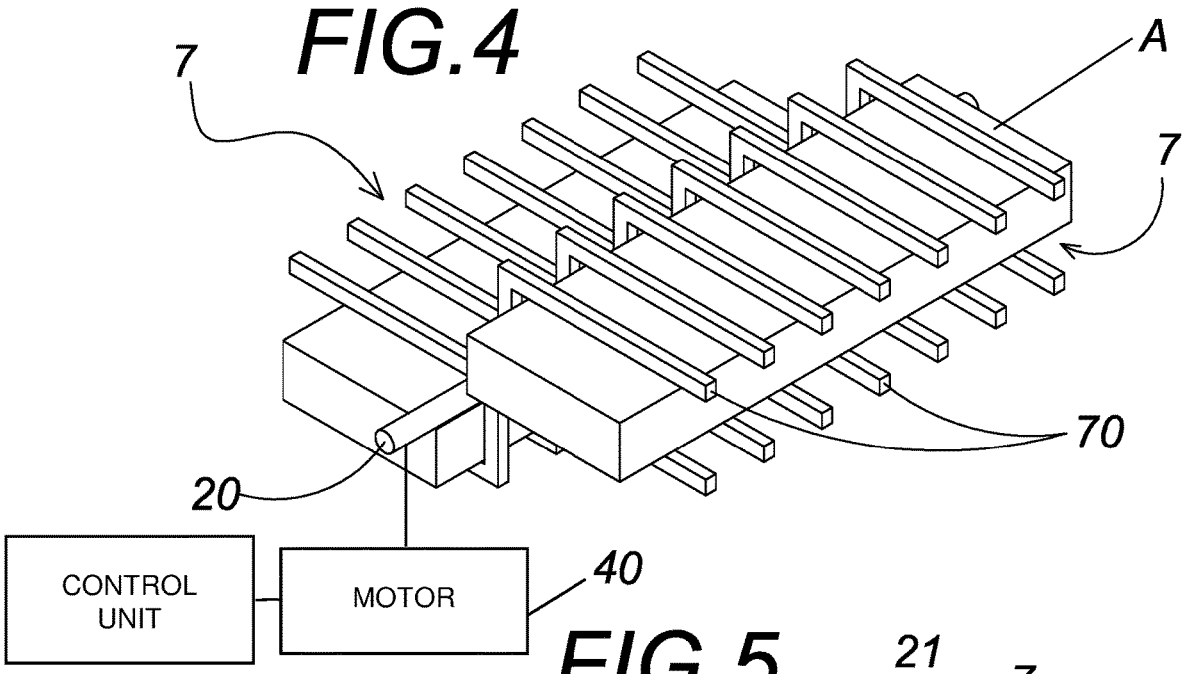
FIG. 4 is a perspective view of the turning means present in the feeder station.
Figure 5:
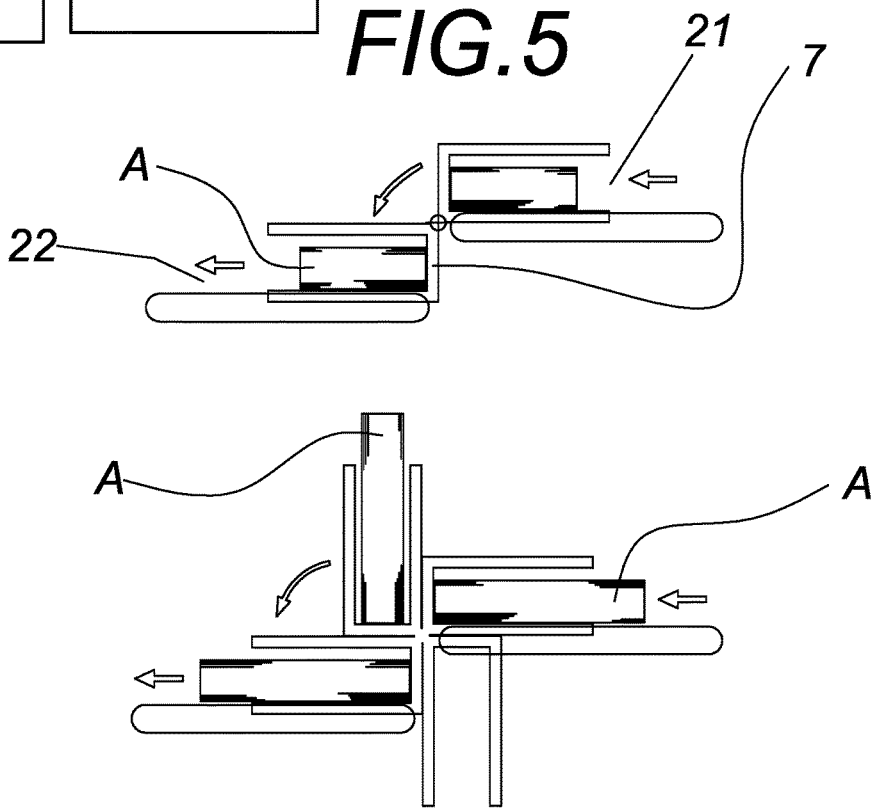
FIG. 5 is a schematic elevation view of the operation of the turning means shown in FIG. 4 wherein the advance direction of the group of laminar element is shown by arrows, the top figure showing turning means formed by two forks that extend in opposite directions to each other and in the bottom figure they are comprised by four forks arranged in a cross (when seen in elevated side view).

With respect to the aforementioned turning means, they comprise a structure provided with two forks joined together, as shown in FIG. 4, although the number of forks may be greater, for example, four. Each fork (7) defines a housing for the arrangement of the group of laminar elements to be turned. The forks (7) are formed by a plurality of spikes (70) that pass between the free spaces between a plurality of transport belts that form part of the movement means located in the inlet area (21) and outlet area (22) of the turner. Said forks are linked to rotation means (not shown) coupled to the aforementioned structure, said rotation means being associated to motor means linked to a control unit. In a preferred embodiment, the rotation means comprise a central rotation shaft (20) from which the fork-shaped sections extend, which is coupled to an electric motor (40) (shown in FIG. 4).

As may be seen, the transfer device (4) comprises first transport means based on rotating rollers (11) and second transport means based on a plurality of conveyor belts (9) located parallel to each other, each one of them linked to rotating pulleys (10), the rotation axis of the rotating rollers (11) being perpendicular to the rotation axis of the pulleys (10).

Figure 2:
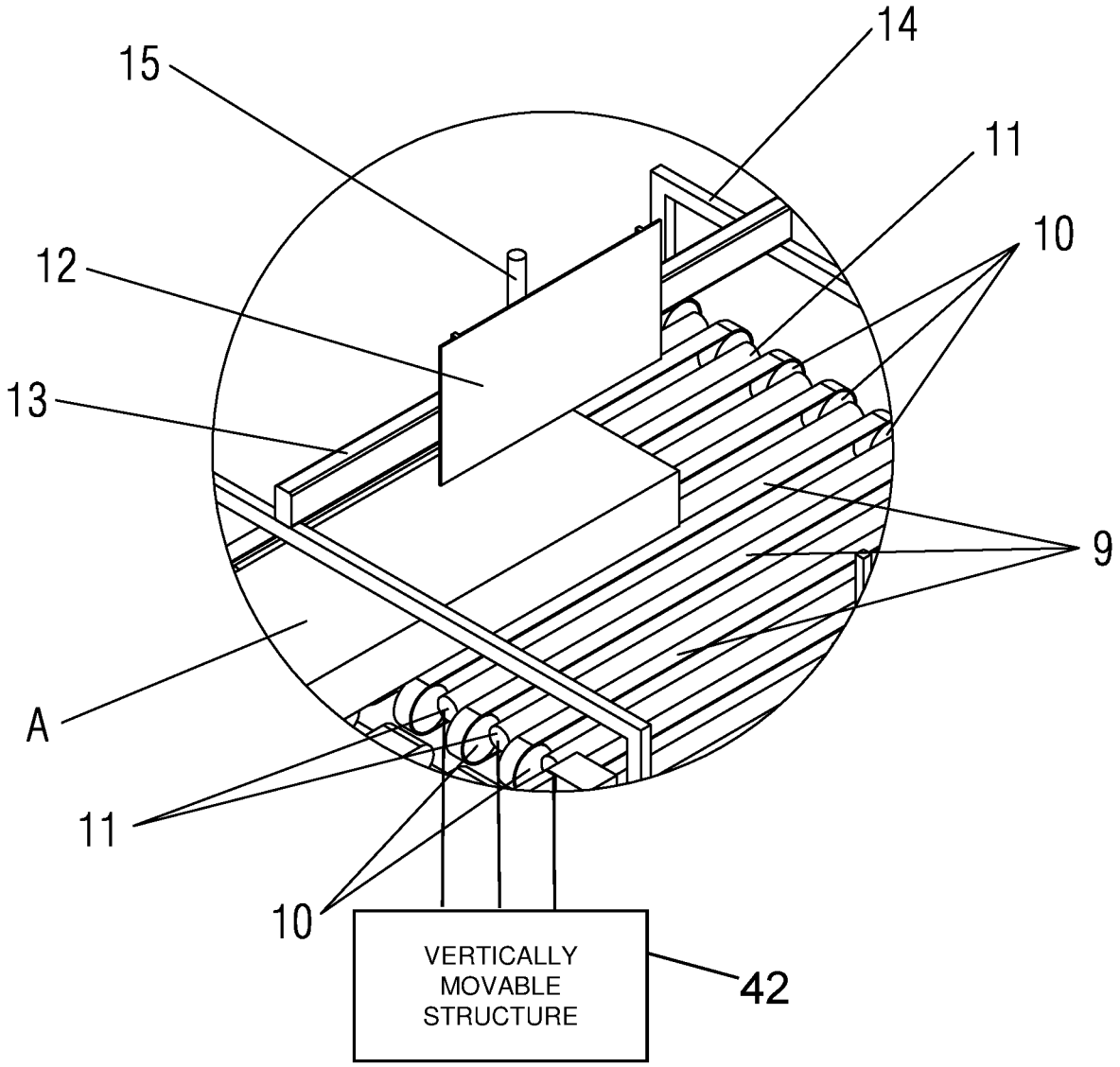
FIG. 2 is a detailed view of a region of the transfer that forms part of the station of the invention.

The rotating rollers (11) are joined integrally or in groups to one or more vertically movable structures (42) (shown in FIG. 2), such that in a first operating position, the contact surface of the rotating rollers (11) with a laminar element is located on a plane above the contact surface of a laminar element with the conveyor belt and in a second operating position, the contact surface of the rollers is located below the contact surface of the conveyor belt.

Now referring to the stop means in the transfer device (4), they comprise a plate (12), which acts as a wall, which is supported on a support structure (13) that may move axially on a gantry structure (14) arranged in the upper portion of the transfer device (4) as well as guide means to raise and lower the plate (12). In this embodiment, the guide means comprise a vertical column (15) on which the plate (12) moves in a guided manner. The different movements carried out by the plate (12) are managed by the control unit.

A transport structure, generally indicated with reference (16), is provided between the transfer device (4) and the introducer (5), which enables the group of laminar elements to be moved, by movement means, from the transfer device (4) to the introducer (5), said transport structure (16) including an encasing stop (17) arranged in an intermediate portion. Thus, as may be seen in FIGS. 1 and 3*a*-3*j*, the reception area (2), transfer device (4) and transport structure (16) adopt an "L"-shaped configuration.

This encasing stop (17) is provided to individually distribute the laminar elements (3) inside the introducer (5). In this way, a gradual loading takes place in the feeder area of the introducer (5).

The aforementioned movement means may comprise a plurality of conveyor belts (18) arranged parallel to each other in a frame (19). Advantageously, in this case the conveyor belts (18) are telescopic in order to adapt to the size of the laminar body.

It should be noted that if the laminar body has a width smaller than half the maximum width of the introducer (5), it is possible to work with two lines of introduction of laminar material, i.e., the groups of laminar elements can be manipulated before entering the introducer (5) such that they form two rows, as shown in FIG. 3*e*-3*j*. In this case, the transport means formed by the conveyor belts (18) may operate such that they are distributed in two transport groups, each transport group acting for each row.

The operating method of the feeder station (1) for a group of laminar elements described above is detailed below.

Figure 3A:
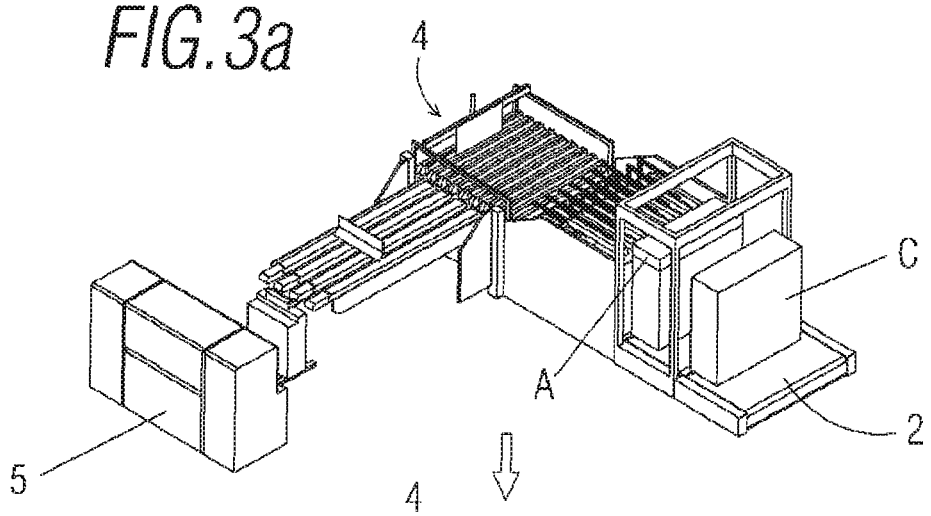
FIGS. 3*a*-3*k* are sequential perspective views of the stages that make up a method by means of the feeder station shown in FIG. 1.

Firstly, and as shown in FIG. 3*a*, a plurality of laminar elements (3) are grouped in an orderly manner located on a horizontal plane in a vertical grouping (A) based on an initial column (C) of laminar elements coming from, for example, a corrugating or shaping machine of laminar elements, such that the longitudinal axis (E) of the laminar elements is located perpendicular with respect to an advance direction of the group (A), the advance direction of the group being perpendicular to the advance direction (fi) of the introducer (5).

Figure 3B:
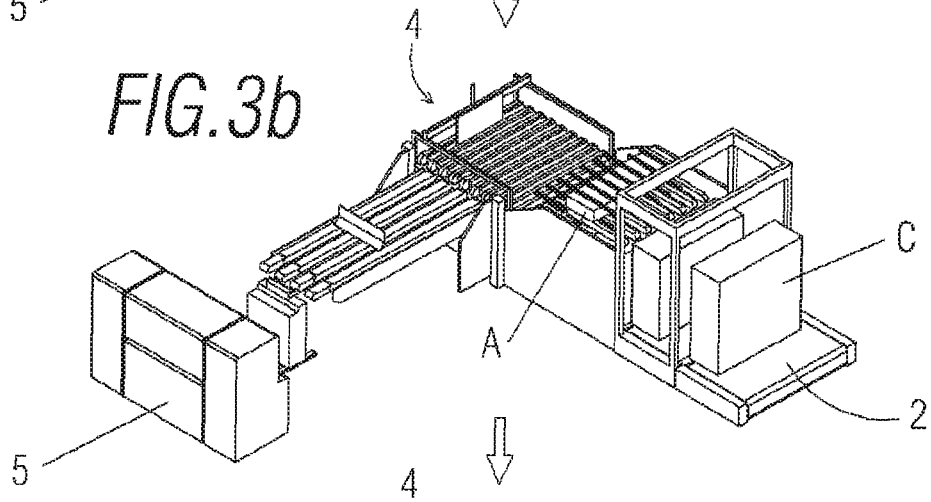
Figure 3C:
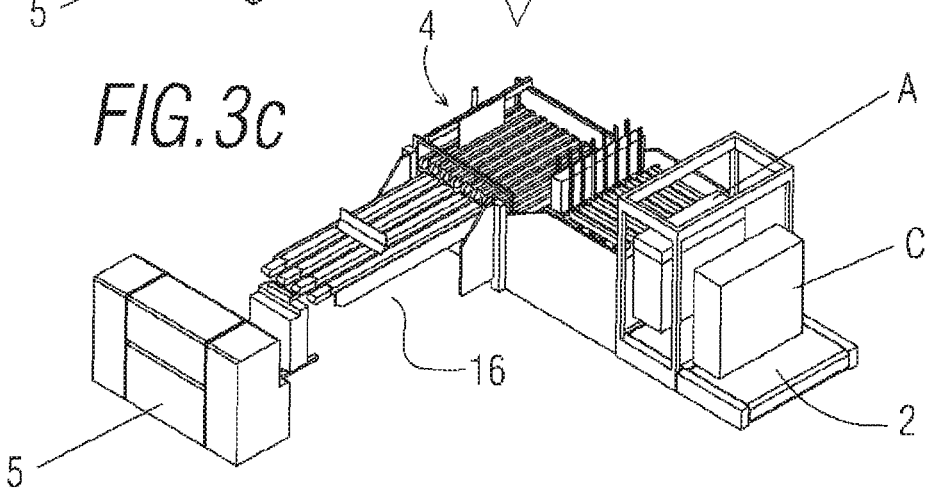
Figure 3D:
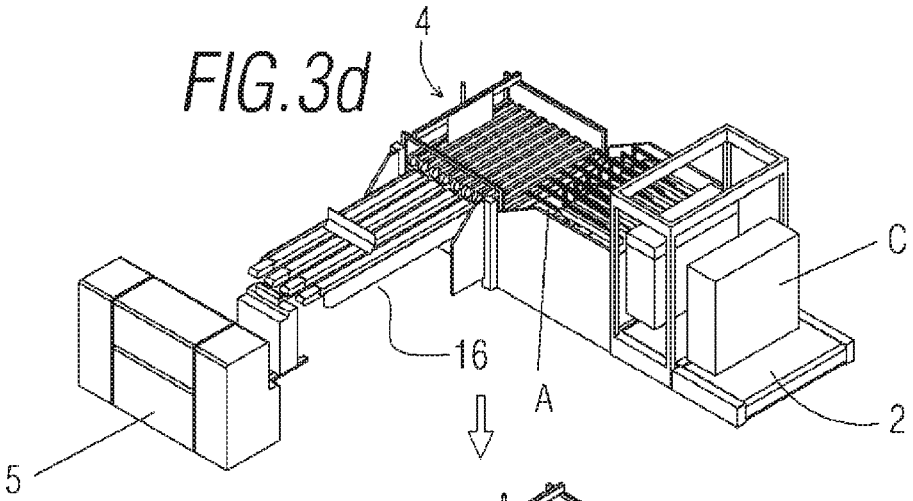

Then, the group of laminar elements (3) is turned 180 degrees with respect to a rotation axis (not shown) that is parallel to the advance direction of the introducer (5), such that the upper face of each one of the laminar elements is oriented downwards, as shown in FIGS. 3*b*-3*d*.

Figure 3E:
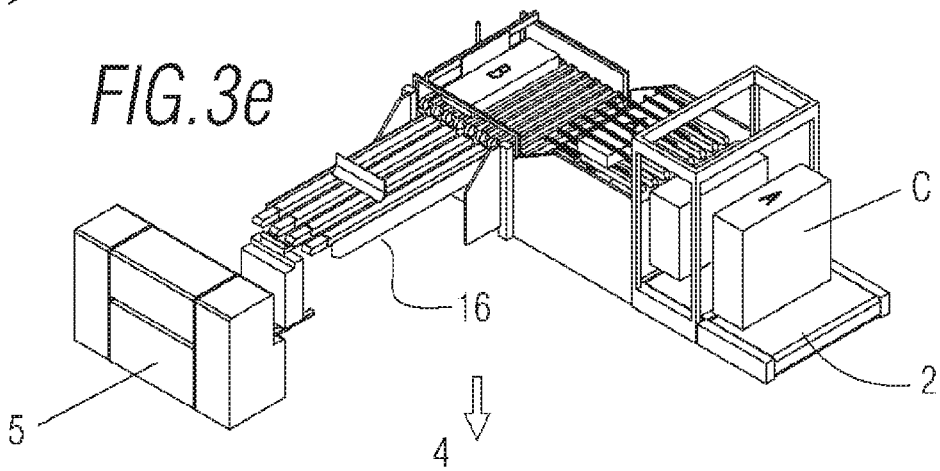

Then, as shown in FIG. 3*e*, the group A of now turned laminar elements continues to move in an advance direction perpendicular to the advance direction of the introducer (5) through the first transport means up to the stop means located in the transfer device. At the same time, the second group (A) enters the turner.

Figure 3F:
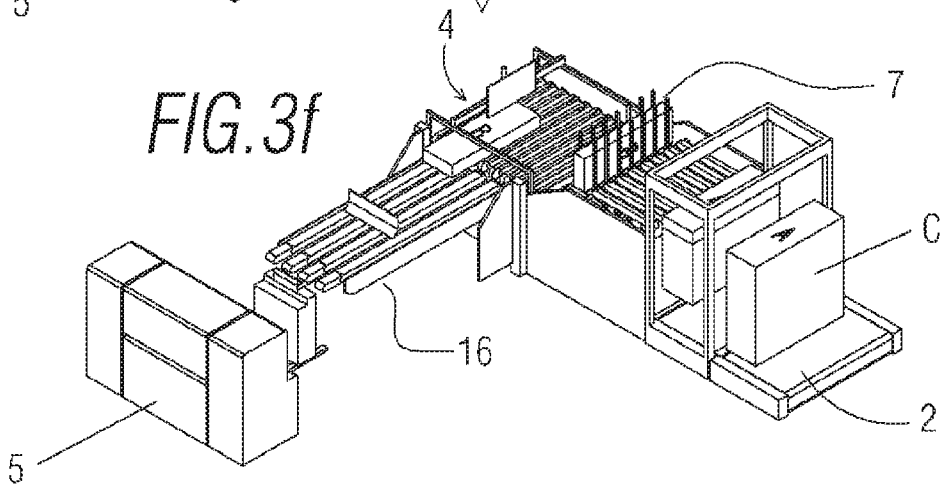
Figure 3G:
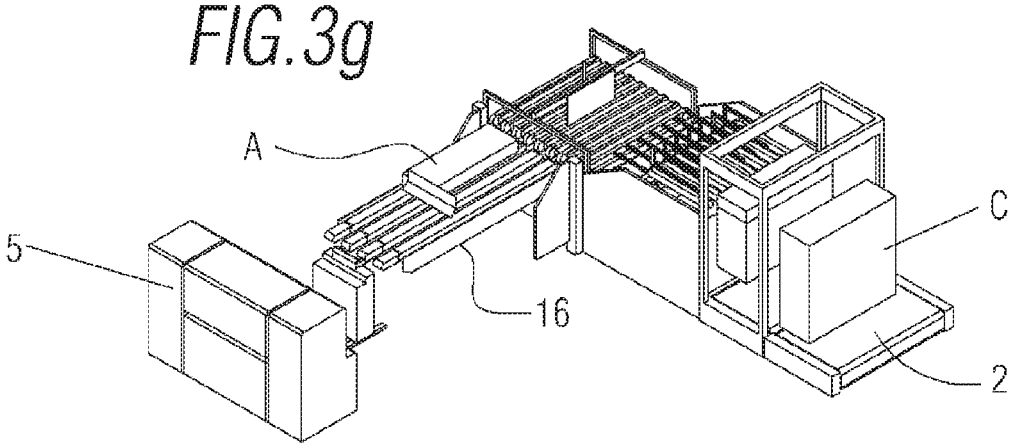

Then, as shown in FIGS. 3*f* and 3*g*, the group of laminar elements moves in the same direction as the advance direction (fi) of the introducer (5) through transport means, the advance direction being parallel to the longitudinal axis (E) of the laminar elements (3).

Figure 3H:
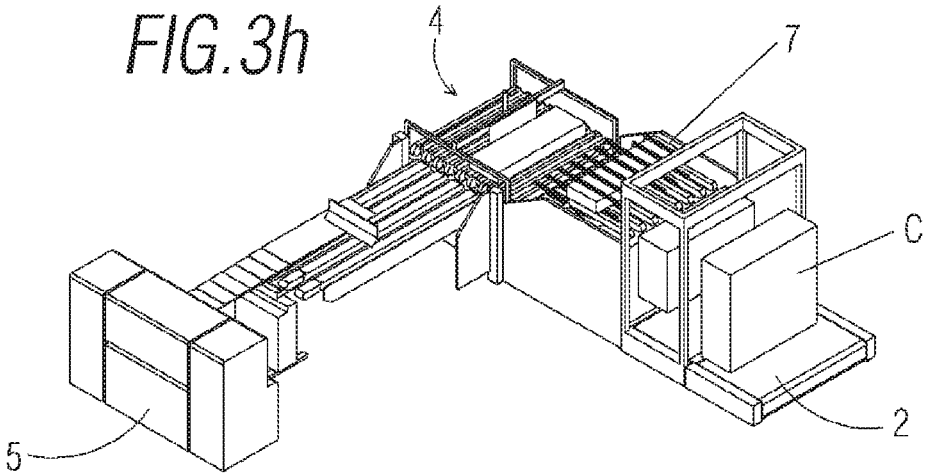

Subsequently, and as shown in FIG. 3*h*, the group (A) passes through the encasing stop (17), such that the laminar elements (3) of the group (A) are separated and are individually arranged horizontally before arriving at the loading area of the introducer (5). The same FIG. 3*h* shows how the stop of the transfer device (4) moves forward in order to slow the second group (A) in a position such that it enables creating a new row of laminar elements that is parallel to the previous row.

Figure 3I:
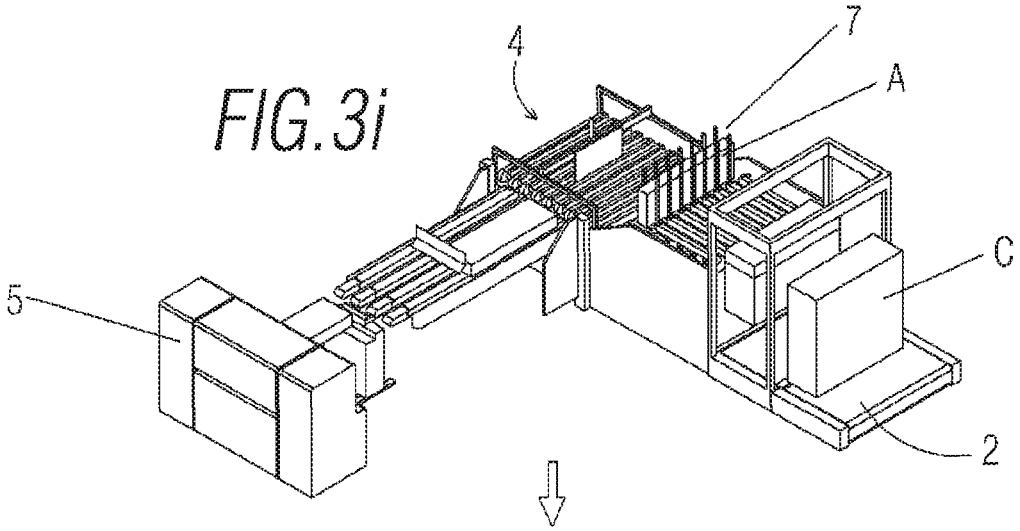
Figure 3J:
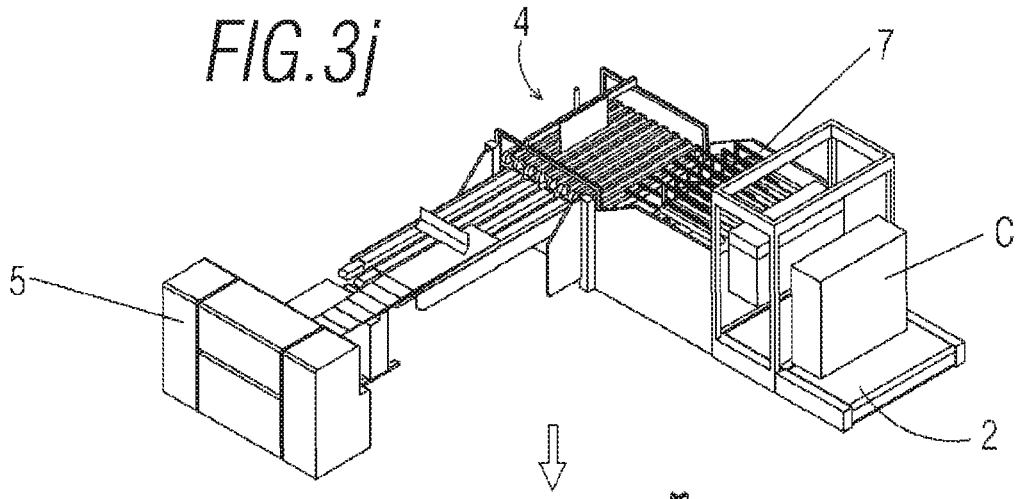

FIGS. 3*i* and 3*j* show how the second group (A) follows the same stages as the previous group.

Figure 3K:
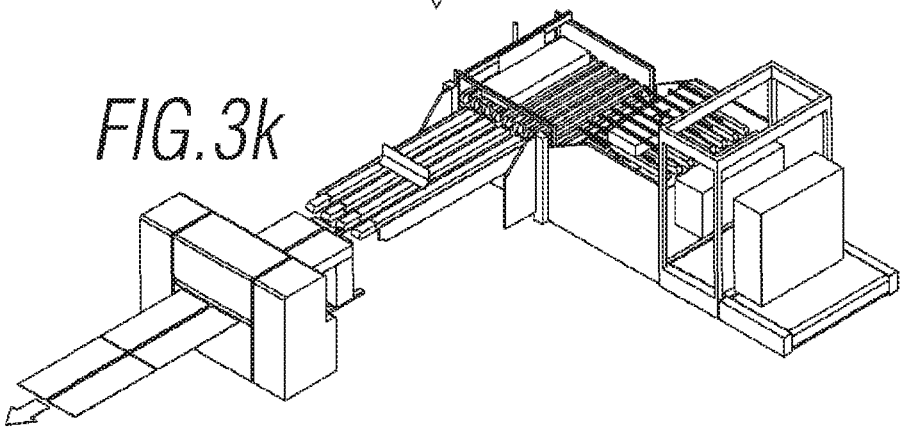

Lastly, FIG. 3*k* shows the introducer (5) introducing two parallel rows of laminar elements, such that two work lines are created.

The details, shapes, dimensions and other accessory elements used to manufacture the feeder station of the invention may be suitably substituted for others which do not diverge from the scope defined by the claims included below.

The invention claimed is:

1. A feeder station of laminar elements, for supplying laminar elements to an introducer, comprising:

a reception area for receiving laminar elements arranged in a group stacked one on top of the other;

turning means for rotating 180° the laminar elements coming from the reception area; and a transfer device provided with stop means and movement means for moving in two directions perpendicular to each other, the laminar elements coming from the turning means towards an outlet area oriented in the advance direction of the introducer, wherein the turning means comprises a structure provided with a plurality of fork-shaped sections that are arranged in the shape of a cross, each one provided with a plurality of spikes that define a housing for the arrangement of the plurality of laminar elements, and rotation means coupled to the structure, said rotation means being associated with motor means linked to a control unit, wherein the plurality of spikes pass between the free spaces between a plurality of transport belts that form part of the movement means located in the inlet and outlet area of the turner.

2. The feeder station according to claim 1, wherein the reception area includes lifting means provided for handling a plurality of laminar elements coming from the group of laminar elements towards a horizontal support platform arranged before the turning means.

3. The feeder station according to claim 2, wherein the horizontal platform includes movement means on which the plurality of laminar elements moves.

4. The feeder station according to claim 3, wherein the movement means comprise at least one transport belt movable by means of rotating pulleys ending in the area where the turning means are arranged.

5. The feeder station according to claim 1, wherein the transfer device comprises first transport means based on rotating rollers and second transport means based on a plurality of conveyor belts linked to rotating pulleys, the rotation axis of the rotating rollers being perpendicular to the rotation axis of the pulleys.

6. The feeder station according to claim 5, wherein the rotating rollers are joined to vertically movable structures, such that in a first operating position, the contact surface of the rotating rollers with a laminar element is located on a plane above the contact surface of a laminar element with the conveyor belt and in a second operating position, the contact surface of the rollers is located below the contact surface of the conveyor belt.

7. The feeder station according to claim 1, wherein the stop means comprise a plate supported on a support structure that may move axially in the transfer device.

8. The feeder device according to claim 1, wherein the stop means include guide means to raise and lower the plate.

9. An introducer assembly of laminar elements comprising an introducer linked to a feeder station according to claim 1, wherein the advance direction of the introducer is perpendicular to the advance direction of the reception area of the feeder station.

* * * * *